United States Patent [19]

Manning et al.

[11] Patent Number: 4,918,963

[45] Date of Patent: Apr. 24, 1990

[54] RETRACTABLE ROLLING MILL INSTRUMENTATION PLATFORM

[75] Inventors: Jeffrey L. Manning, Forest; Clemens F. Zurlippe, Madison Heights, both of Va.

[73] Assignee: The Babcock & Wilcox Company, New Orleans, La.

[21] Appl. No.: 345,819

[22] Filed: May 1, 1989

[51] Int. Cl.[5] ..... B21B 37/00

[52] U.S. Cl. ..... 72/199; 72/37; 72/21; 248/678

[58] Field of Search ..... 72/237, 240, 199, 12, 72/9, 16, 17, 31, 35, 36, 13, 37, 21; 248/637, 678, 27.1; 356/375

[56] References Cited

U.S. PATENT DOCUMENTS

| | | | |
|---|---|---|---|
| 2,332,289 | 10/1943 | Zeitlin | 72/37 |
| 2,660,077 | 11/1953 | Macaulay et al. | 72/12 |
| 3,190,261 | 6/1965 | Ziffer | 72/9 |
| 3,225,202 | 12/1965 | Rich, Jr. et al. | 72/12 |
| 3,290,913 | 12/1966 | Wilson | 72/12 |
| 3,955,389 | 5/1976 | Foster | 72/9 |
| 4,186,579 | 2/1980 | Eibe | 72/35 |

*Primary Examiner*—Daniel C. Crane

*Attorney, Agent, or Firm*—Robert J. Edwards; Michael L. Hoelter

[57] ABSTRACT

A retractable instrumentation platform for supporting instrumentation adjacent a roll of a rolling mill. This platform is accurately positioned within a rolling mill at a preselected elevation and it is retractable away from the monitored roll, when desired, for maintenance or other purposes. The re-positioning of this platform within the rolling mill after being retracted is accurately controlled such that it is returned back to its original reference elevation without the need to re-calibrate the supported instrumentation.

6 Claims, 5 Drawing Sheets

RETRACTABLE ROLLING MILL INSTRUMENTATION PLATFORM

FIELD OF THE INVENTION

This invention pertains to rolling mill instrumentation platforms and more particularly to a retractable platform for use in the collection of real-time process data.

BACKGROUND OF THE INVENTION

In the past, efforts to upgrade hot rolling mills or their processes have been hampered by a lack of meaningful engineering feedback data. Attempts to collect product thickness and temperature profile data were restricted by the unavailability of highly sensitive and accurate non-contacting sensors. Normally, product thickness data (or roll gap) is obtained from a dial readout coupled to the upper roll lifter screw spindles. Such readings, however, are not very reliable because spindle nut backlash and frame springback conditions are not taken into consideration. Similar inaccurate methods and devices are generally used to determine the temperature of the rolled product.

Additionally, obtaining accurate roll gap and product temperature data in real time is important if the rolling process is to react to subtle changes in the operating conditions. Real time data also enables an operator to reduce the occurrence of and/or to prevent product loss situations. Another benefit of such fast accurate data is the ability to maintain high levels of product quality and control. Obviously, should the rolling process be operated in accordance with inaccurate or delayed data, manufacturing efficiency suffers while product loss increases. In essence, the knowledge gained by accurate, real-time data should provide a deeper insight into the mechanics of the rolling process. It should also lay the groundwork for optimized pack designs through improved calculational methods and with less reliance on trial and error practices.

Preferably, the selected sensors have to be of the non-contacting variety in order to eliminate premature wear. For maximum reliability, they also need to be installed in locations away from radiant heat exposure as well as being shielded against mechanical damage. Such locations, however, still have to satisfy the specific measuring range, signal resolutions, and response time requirements of each unit to guarantee overall system performance.

The recent introduction of laser shadow and infrared thermometry gages seem to be suited to these requirements. Consequently their integration into a structurally and thermally stable instrumentation platform is desired. This arrangement would make it possible to (a) measure side-to-side positional changes of the upper height-adjustable roll, and (b) record the lengthwise temperature profiles of the incoming and exiting rolled product at a level of accuracy heretofore never achieved. The instrumentation platform must also be vertically retractable so that the inside of the roll mill is readily accessible for roll change and routine maintence work.

Ideally, the data collected would be fed into a computerized data collection system from where it can be readily retrieved for subsequent data analysis. Once a sufficiently large control data base has been developed, the system could then be fine-tuned to recognize subtle changes in operating conditions in time to prevent product loss situations.

Consequently, it is an object of this invention to provide a rolling mill user with means for obtaining accurate process data in real time. A further object of this invention is to provide the capability of quickly retrieving data from a computerized data base. Another object of this invention is the ability to quickly identify and report discrepant process conditions. A still further object is the capability of instantly checking the rolling mill alignment, roll gap, and temperature of the product. Another object is the ability to quickly reset the mill between passes and to provide vertical clearance to ease roll changes and maintenance work. Still another object is to provide a structurally and thermally stable instrumentation platform. These and other objects of this invention will become apparent upon a reading of the text.

SUMMARY OF THE INVENTION

An instrumentation platform for supporting instrumentation adjacent a roll of a rolling mill. This instrumentation platform includes a generally flat rigid plate that is further stiffened by bracing means secured to the plate. Positioning means are provided for accurately positioning this plate with respect to the rolling mill. These positioning means comprise a first portion secured to the plate and a second portion secured to the rolling mill. Retracting means are used to retract the plate from its accurately positioned location with these retracting means being secured to a framework which, in turn, is secured to the rolling mill. Operating means are supplied for retracting this plate and for moving this plate between its accurately positioned location and a position away from this location.

DETAILED DESCRIPTION OF THE INVENTION

Figure 1:
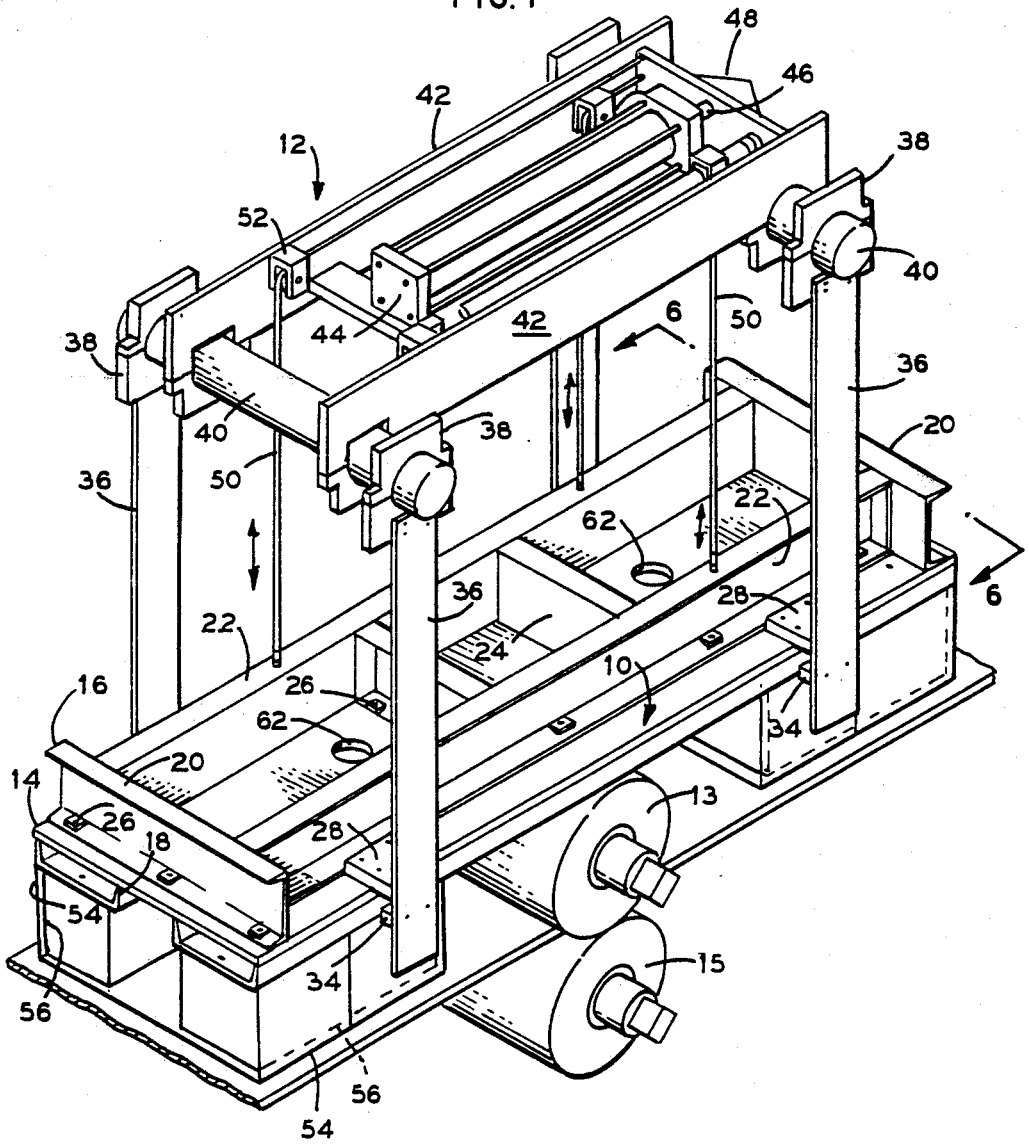
FIG. 1 is an isometric view of the instrumentation platform in the lowered position with supporting hardware.
Figure 2:
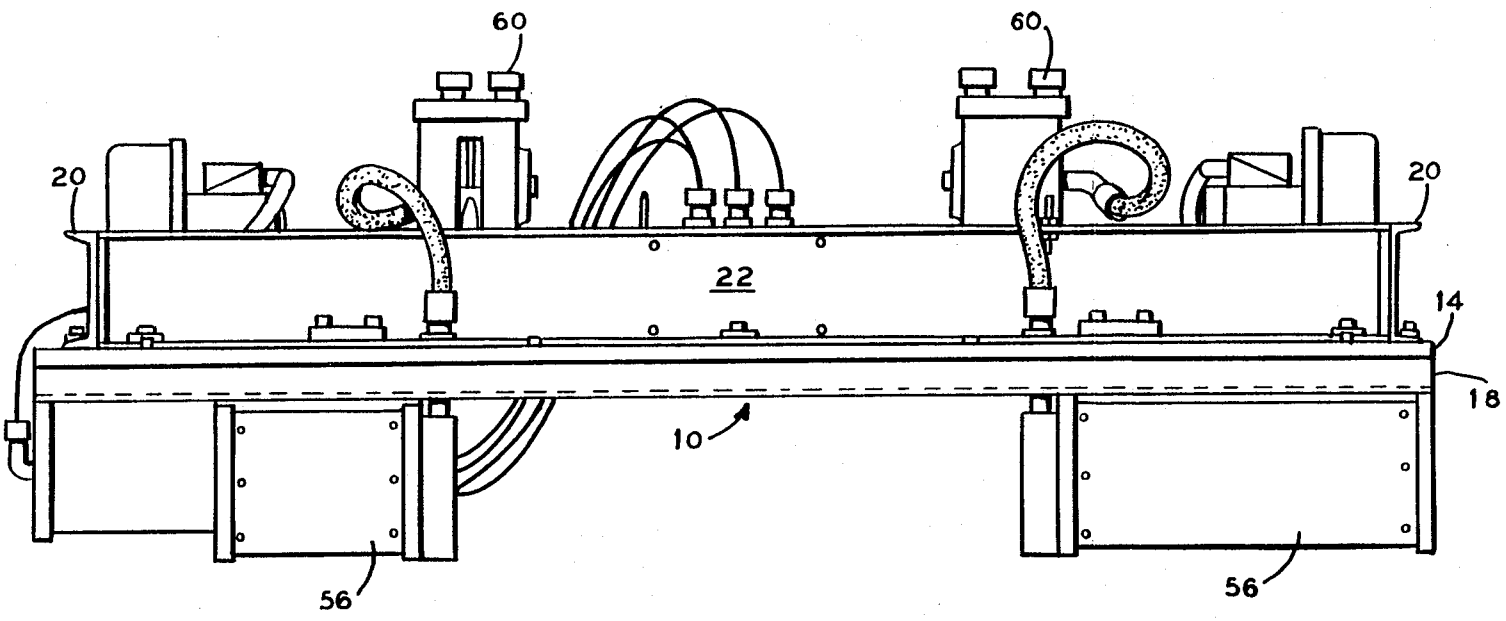
FIG. 2 is a pictorial view of the instrumentation platform while undergoing assembly.

Referring to FIGS. 1 and 2, there is shown retractable rolling mill instrumentation platform 10 and support frame 12. In FIG. 1, platform 10 is shown in the lowered position but as will be described later, it can be raised when needed to an elevation just below support frame 12. As can be seen, when platform 10 is in this lowered position, it is just above and straddles rolls 13 and 15.

In this embodiment, platform 10 consists of a rectangular base plate 14 that is kept planar by means of a network of upper 16 and lower 18 stiffening members secured respectively to the upper and lower surfaces of plate 14. As shown, stiffening members 16 and 18 are bolted to plate 14 but they could also be welded or otherwise rigidly fastened to this plate so as to maintain its planar characteristic. Additionally, other structural shapes can be used for stiffening members 16 and 18 rather than the channels illustrated so long as these other shapes provide the rigidity required to keep plate 14 planar.

Upper network 16 in this embodiment comprises end channels 20, longitudinal channels 22, and cross brace or stiffener channels 24. End channels 20 are fastened along both ends of plate 14 and they are vertically oriented such that bolts 26 pass through their lower flanges. Longitudinal channels 22 extend longitudinally along plate 14 between end channels 20. These longitudinal channels 22 are also vertically oriented with bolts 26 passing through their lower flanges to secure them to plate 14. Both end face channels 20 and longitudinal channels 22 are oriented such that their open sides face outward away from the now surrounded interior of plate 14.

Cross brace or stiffener channels 24 extend between longitudinal channels 22 and they too are bolted to plate 14 via bolts 26. These brace channels 24 are also vertically oriented and they brace or stiffen both plate 14 and longitudinal channels 22. They also separate the interior of plate 14 into separate compartments for use by the various instrumentation packages all to be supported by plate 14.

Lower channels 18 are illustrated as being oriented with the ends of their flanges facing upward and in contact with the lower surface of plate 14. Channels 18 extend along the entire length of plate 14 and they too stiffen and brace plate 14 to prevent it from bending or buckling.

Figure 6:
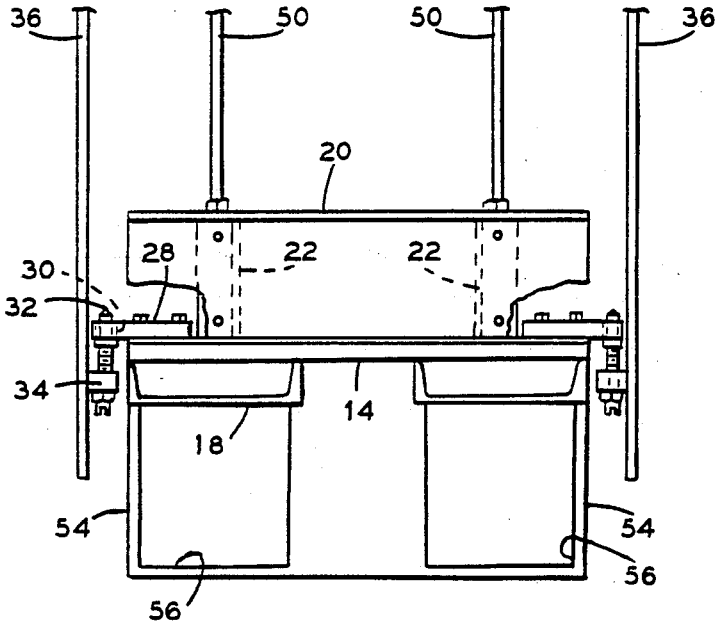
FIG. 6 is an end view, partially broken away, taken along lines 6—6 of FIG. 1.
Figure 5:
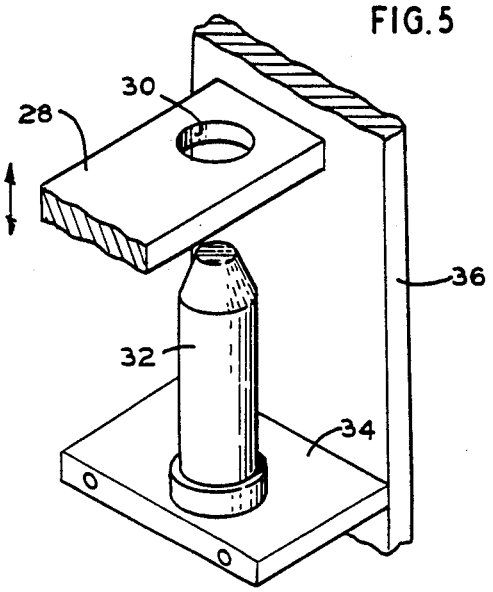
FIG. 5 is a isometric view of a typical locating flat, pin and bar.

As shown, end channels 20 are located adjacent the end regions of plate 14 whereas longitudinal channels 22 are inset a slight distance from the longitudinal sides of plate 14. This is to permit the installation of four locating flats 28. Each locating flat 28 (see FIG. 5 and 6) is securely affixed to plate 14 via bolts 26 with a portion of each flat 28 extending slightly beyond the edge of plate 14. This extending region contains opening 30 which is sized large enough to pass around locating pin 32. Pin 32 is secured to support bar 34 which is itself rigidly secured to a lower face region of side bar 36.

When platform 10 is in its lower position, each locating flat 28 is postioned around its respective support pin 32. These locating pins 32, and, by necessity, their respective support bars 34, are secured at a known elevation such that the elevation of plate 14 becomes a fixed and known reference value. The rigidity of plate 14 is such that it remains rigid and planar even when loaded with instrumentation. This is necessary if accurate data is to be determined since plate 14 is the benchmark or reference elevation. From plate 14, measurements can be taken involving distance or gap because of its planar characteristic and its built-in rigidity.

Side bar 36, which supports locating pin 32, is fastened at its upper end to split collar 38 that encircles platform support bar 40. Bar 40 spans across the top of platform 10 and connects together one pair of oppositely spaced side bars 36. This arrangement is duplicated at both ends of plate 14 with each arrangement of side bar pairs being connected together by side plates 42 that span perpendicular to bars 40.

Supported from side plates 42 and platform support bars 40 is hydraulic cylinder 44. The extendable rod 46 of cylinder 44 connects to bar 48 that is horizontally moved, on demand, either away from or closer to hydraulic cylinder 44. A series of tensile members 50, such as a chain or cable, are secured to bar 48 with the other end of each tensile member 50 being secured to an upper flange of longitudinal channels 22. Tensile members 50 pass over sprocket 52 such that the horizontal movement of bar 48 translates into the vertical movement of longitudinal channels 22 and hence platform 14.

Underneath platform 10 and in sliding contact with the flange edges of lower channels 18 are heat shields 54. These shields 54 surround the typical locations for laser shadow gages 56, these locations being along both ends of plate 14 and on opposite sides of the longitudinal axis of upper roll 13. Essentially, heat shields 54 and laser gages 56 extend down past the top of roll 13 (it can be said that they straddle roll 13) such that a laser beam can be generated on one side of roll 13 and a laser shadow can be detected on the other side of roll 13. In the present embodiment, it does not matter whether the light generating unit is on the upstream side of roll 13 with the corresponding light detecting unit on the downstream side or vice versa. It is only important that laser gages 56 be consistantly placed in the same location so that they need not be re-calibrated after each raising and lowering of platform 10. The ridigity of plate 14 and the accurate positioning of this platform with respect to locating pins 32 satisfies this criteria.

Secured to an upper surface of plate 14 and interior of end and longitudinal channels 20 and 22 are infrared thermometry gages 60 (FIG. 2). These gages 60 project through openings 62 in plate 14 to determine the upstream and downstream temperature of the product being rolled.

Figure 3:
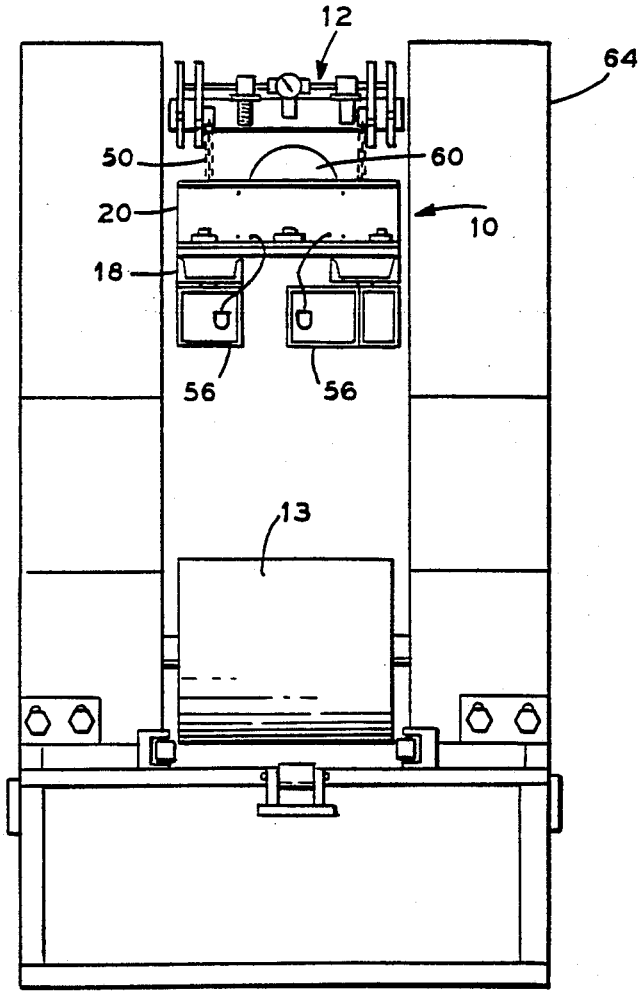
FIG. 3 is a front pictorial view of the instrumentation platform installed on a rolling mill and in the raised position.
Figure 4:
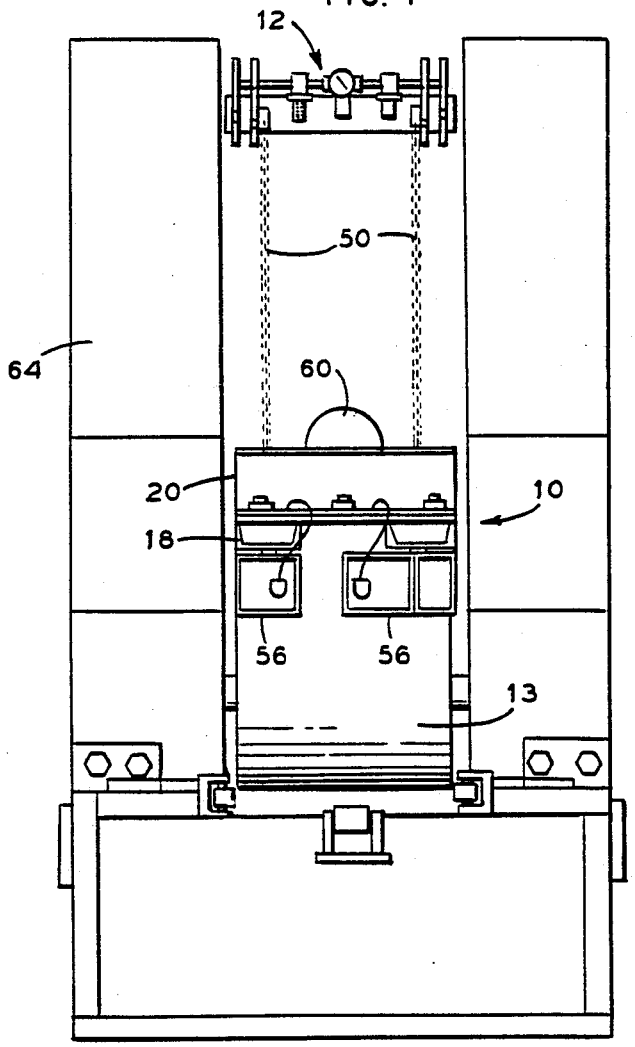
FIG. 4 is a front pictorial view of the instrumentation platform installed on a rolling mill and in the lowered position.

Referring now to FIGS. 3 and 4, there is shown platform 10 and support frame 12 secured to roll mill 64. Side bars 36 of frame 12 are bolted or otherwise rigidly secured to the interior of the uprights of mill 64. As previously discussed, they are installed with critical attention being paid to the elevation of locating pins 32 and support bars 34. This is so that when platform 10 is lowered (FIG. 4), it remains level and planar at a predetermined elevation for measurement purposes.

To lower platform 10 from its raised position (FIG. 3), hydraulic cylinder 44 is operated by controls (not shown) to retract extendable rod 46. By doing so, tensile members 50 lower platform 10 along support frame 12. During this process, locating pins 32 rigidly secured to frame 12 pass through openings 30 in locating flats 28 secured to platform 10. These pins 32 align platform 10 and upon coming to rest support platform 10 at the proper elevation.

Laser gages 56 and thermometry gages 60, attached to platform 10, are then placed in operation to measure and record the thickness (roll gap) and temperature of the rolled product. As stated earlier, laser gages 56 are mounted underneath platform 10 and are enclosed by heat shield 54 to protect them from the heat of the rolled product. This suspended position is necessary in order to shoot a beam of light across the top of upper roll 13 to create a shadow that is sensed by the receiving unit secured underneath the opposite end of platform 10. By use of this laser shadow gage instrumentation, and by spacing these units laterally across the face of upper roll 13, roll elevation and tilt or differences in roll gap across the roll (and hence the variation in thickness of the rolled product) can be monitored. Receiving these signals as an output in real time enables the operator to make in time adjustments to maintain quality control with little or no product loss.

The temperature of the rolled product is similarly monitored in real time by means of thermometry gages 60 supported on platform 10. Their sensors are positioned to take temperature readings through openings 62 in plate 14. Since openings 62 are positioned on both sides of upper roll 13, the upstream and downstream temperature of the rolled product can be monitored.

After the rolling operation is completed, platform 10 can be raised out of the way by reactivating cylinder 44 to extend rod 46 thereby causing tensile members 50 to lift platform 10. This raising of platform 10 may be desired for routine maintenance purposes or to permit roll removal and/or replacement. When such work is completed, platform 14 can be re-lowered and after bottoming out on self-aligning locating pins 32 it once again serves as a reference plane for the instrument gages supported thereon.

What is claimed as invention is:

1. A rolling mill instrumentation platform comprising:

(a) a generally rectangular, rigid plate;

(b) stiffening means fixedly secured to said plate for maintaining the rigidity of said plate;

(c) positioning means for accurately positioning said plate with respect to a rolling mill, said positioning means comprising a first portion secured to said plate and a second portion secured to said rolling mill;

(d) retracting means for retracting said plate from said accurately positioned location, said retracting means comprising a framework secured to said rolling mill;

(e) operating means for moving said plate between its said accurately positioned location and an elevated position above said accurately positioned location; and, (f) support means for securing instrumentation to said plate, said support means comprising a housing secured to said plate on each side of the longitudinal axis of the monitored roll of said rolling mill, said housings enclosing and protecting the said instrumentation from the adjacent environment of said rolling mill.

2. A rolling mill instrumentation platform as set forth in claim 1 wherein each said housing is secured underneath said plate with each said housing extending downward below the top of said monitored roll.

3. A rolling mill instrumentation platform as set forth in claim 1 wherein said operating means comprise an air operated cylinder coupled to said plate via elongated tensile resisting members, said cylinder being supported by said framework and thus by said rolling mill.

4. A rolling mill instrumentation platform as set forth in claim 3 wherein said elongated tensile resisting members comprise a flexible chain.

5. A rolling mill instrumentation platform as set forth in claim 3 wherein said stiffening means comprise a plurality of channels rigidly affixed to said plate.

6. A rolling mill instrumentation platform as set forth in claim 5 wherein:

(1) said first portion of said positioning means comprise a plurality of locating flats secured at spaced intervals to said plate, each said locating flat extending outward beyond said plate a preselected distance with an opening in this extending portion of each said locating flat; and, (2) said second portion of said positioning means comprise a plurality of locating pins fixedly secured to said rolling mill at a preselected elevation, each said locating pin sized to fit within its respective said opening in its respective said locating flat whereby said locating pins accurately align said plate with respect to said rolling mill.

* * * * *